US006672032B2

(12) United States Patent
Van Der Burgt et al.

(10) Patent No.: US 6,672,032 B2
(45) Date of Patent: Jan. 6, 2004

(54) PACKAGING SYSTEM FOR ONE OR MORE MEDICAL DEVICES

(75) Inventors: Robertus Gerardus Franciscus Van Der Burgt, Eindhoven (NL); Niek Aloysius Bink, Eindhoven (NL); Pim Alexander Van De Griendt, Eindhoven (NL); Adrianus Martinus Vennix, Eindhoven (NL); Henricus Adrianus Maria Van De Loo, Eindhoven (NL); Peter Jan Berkvens, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 19 days.

(21) Appl. No.: 10/093,276

(22) Filed: Mar. 7, 2002

(65) Prior Publication Data

US 2003/0167737 A1 Sep. 11, 2003

(51) Int. Cl.[7] ..... B65B 67/00
(52) U.S. Cl. ..... 53/390; 414/539; 414/546
(58) Field of Search ..... 53/390, 473; 414/546, 414/547, 548, 543, 539

(56) References Cited

U.S. PATENT DOCUMENTS 4,241,559 A * 12/1980 Klapp ..... 53/244
4,353,198 A * 10/1982 Koppe ..... 53/570
4,443,148 A * 4/1984 Arnemann ..... 414/140.7
4,494,904 A * 1/1985 Hill et al. ..... 414/491
5,058,762 A * 10/1991 Blaushild et al. ..... 220/378
5,136,826 A * 8/1992 Carson et al. ..... 53/443
5,156,519 A * 10/1992 Johansson ..... 414/608
5,957,764 A * 9/1999 Anderson et al. ..... 451/285
6,350,221 B1 * 2/2002 Krull ..... 482/142
6,464,447 B2 * 10/2002 Dupuy et al. ..... 414/546

* cited by examiner

*Primary Examiner*—Eugene Kim
(74) *Attorney, Agent, or Firm*—John Vodopia

(57) ABSTRACT

The invention refers to a packaging system (1) for a medical device, comprising a frame (2) for supporting the device (15) in a laid-down position, said frame being provided with means for assisting in positioning the device towards an essentially upright position during unpacking thereof.

The invention also refers to a method of packing the packaging system (1), comprising the steps of: packing the device (15) in an essentially laid-down position on the frame (2); and preparing the assisting means to assist in unpacking on demand.

Furthermore a method of unpacking the packaging system (1) is proposed, comprising the steps of: activating the assisting means; and unpacking the device packed in the essentially laid-down position with the help of the assisting means towards its essentially upright position.

The method of packing and the method of unpacking are combined into a method of transporting.

9 Claims, 4 Drawing Sheets

PACKAGING SYSTEM FOR ONE OR MORE MEDICAL DEVICES

BACKGROUND

The present invention relates to a packaging system for one or more devices intended for medical use, the packaging system being arranged for transporting at least one of the devices in an essentially laid-down position.

Devices intended for medical use generally include one or more units, such as an imaging unit for imaging a subject and/or a viewing unit for viewing the resulting images and/or peripheral apparatus, such as computers. These units are generally heavy and tall and comprise a lot of costly electrical components.

In practice most of the devices intended for medical use are transported by air. For that purpose a packaging system of the type as described above is known. In the known packaging system the medical device is simply packed horizontally in a box supported by a plastic buffer.

By transporting the devices horizontally any damage that may be caused by falling over can be avoided. Furthermore, when transported horizontally, the height dimensions of the devices are advantageously smaller allowing them to pass the freight doors of smaller airplanes, such as a DC 10, instead of for example a Boeing 747. Smaller airplanes are able to land on smaller airports that generally lie closer to the customer's location. Using the known packaging system a medical device can thus be transported in less time at lower cost.

However, a major drawback of the known packaging system is that the medical device packed therein should be lifted to its upright position during unpacking. Since these medical devices are generally heavy several workers are needed, or, in case only one person performs the unpacking, mechanical means are used, such as a tackle, for bringing the device to its upright position. It will be clear that the unpacking thus is rather time consuming and further involves logistical complications, which will raise the transportation costs involved.

SUMMARY

It is an object of the invention to provide a packaging system for a medical device of the type as described above that solves this problem.

The packaging system according to the invention is thereto characterized in that the packaging system comprises a frame for supporting the at least one device in the laid-down position, said frame being provided with means for assisting in positioning the device towards an essentially upright position during unpacking thereof.

Providing the frame with means for positioning the medical device in an essentially upright position allows for it to be quickly and easily unpacked by just one person. Using the packaging system according to the invention a medical system can be transported at lower overall cost.

In a first preferred embodiment the assisting means comprise one or more pushing elements for at least partly pushing the frame towards an essentially upright position.

The pushing means assist the person who has to unpack the device, usually a field service engineer, in positioning the frame upright.

In a further preferred embodiment the assisting means comprise biasing means for biasing the pushing elements against the force of gravity acting on the frame. The field service engineer can simply release the biasing means to activate the pushing means.

In order to ensure the safety of the personnel the biasing means are arranged to block the pushing elements when the frame is free of load.

According to an economically preferred embodiment the assisting means comprise a spring construction that preferably comprises one or more springs and accompanying spring pressure pieces for biasing each spring. A spring construction in general, and this spring construction in particular, is not only technically reliable, but also relatively cheap. This is of great importance since the packaging system is used for transportations worldwide and is therefore intended for one time use only.

In yet a further economically preferred embodiment the biasing means comprise a spring pressure piece for each spring and an accompanying blocking element that is arranged for blocking the spring pressure piece when the frame is essentially empty and for releasing the spring pressure piece when the frame is loaded with the at least one device. This embodiment also uses technically reliable, but relatively cheap means and is thus very suitable for one time use only.

According to an elegant and practical embodiment the blocking element comprises a pin having a smaller part and a wider part wherein the spring pressure piece is provided with a recess having a width for cooperation with the wider part of the pin and having a smaller deepened portion for cooperation with the smaller part of the pin. Herein advantageously only a small number of mechanical parts is used to block the biasing means for safety purposes in a cheap and reliable fashion.

According to another preferred embodiment the frame comprises means for at least partly rolling the frame. For the personnel rolling is ergonomically preferred over lifting the device.

Preferably the frame is curved at at least one end thereof, in such a way that unpacking the system is only a matter of rolling the packed frame instead of lifting it.

The invention also refers to a frame as described as part of the packaging system according to the invention.

The invention further refers to a method of packing one or more devices intended for medical use using the packaging system according to the invention, said method comprising the steps of: Packing at least one of the devices in an essentially laid-down position on the frame; and preparing the assisting means to assist in unpacking on demand. The device is advantageously packed horizontally, thus saving freight space and allowing the use of smaller airplanes leading to an overall reduction of transportation costs. The measures involved in preparing the assisting means depend on the type of assisting means used. Generally the assisting means are brought into a "ready state" from which they can be activated when necessary.

In a preferred embodiment the method of packing further comprises the steps of: Putting another device intended for medical use on top of the at least one device packed in the essentially laid-down position on the frame; and Placing the frame packed with the at least two devices in a box for transportation. Using this method of packing a medical system comprising two or more devices can be packed in one box. The use of just one box implicates using a minimum of freight space leading to a further reduction of transportation costs. This method is especially useful for packing a mobile C arm system, as will be explained in more detail below.

The invention also to a method of unpacking a packaging system packed with one or more devices intended for medical use according to the method of packing, aid method comprising the steps of: Activating the assisting means; and Unpacking the at least one device packed in the essentially laid-down position with the help of the assisting means towards its essentially upright position. The measures involved in activating the assisting means depend on the type of assisting means used. By using the method of unpacking according to the invention the actual weight of the device to be lifted can be advantageously reduced by such an amount that the unpacking might be performed by just one person according to current working regulations.

The invention is furthermore directed to a method of transporting one or more devices intended for medical use, said method comprising the steps of: Packing the one or more devices according to the method of packing; Transporting the packaging system; and Unpacking at least one of the packed devices according to the method of unpacking. The method of transporting combines the measures and corresponding advantages of both the method of packing and the method of unpacking according to the invention.

BRIEF DESCRIPTION OF THE DRAWINGS

The invention will be further explained by means of the attached drawing, in which.

DETAILED DESCRIPTION

Figure 1:
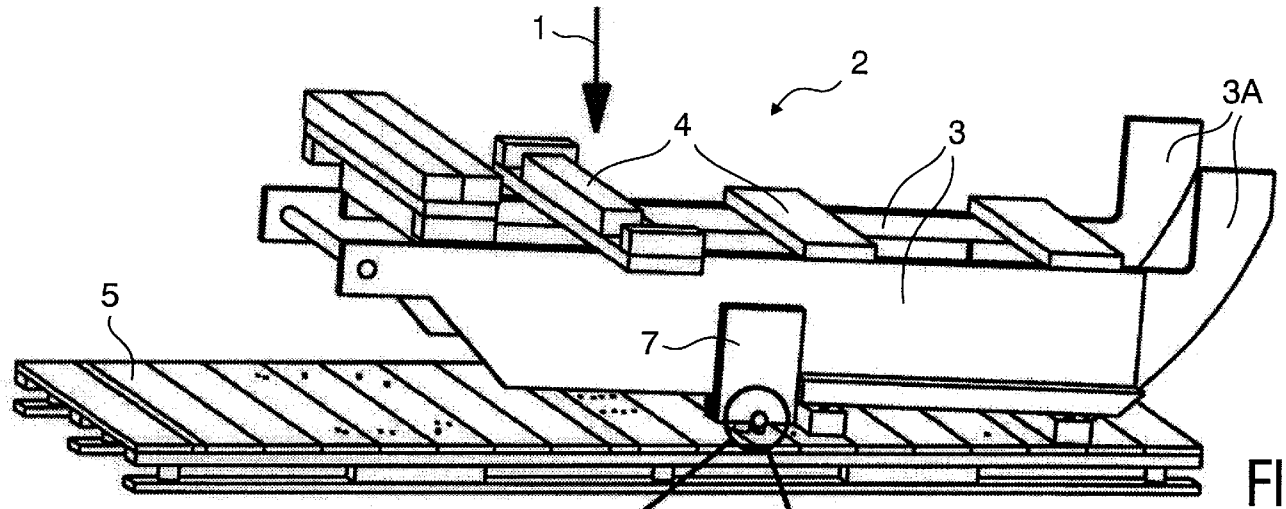
FIG. 1 shows a frame of a packaging system according to the invention.
Figure 2B:
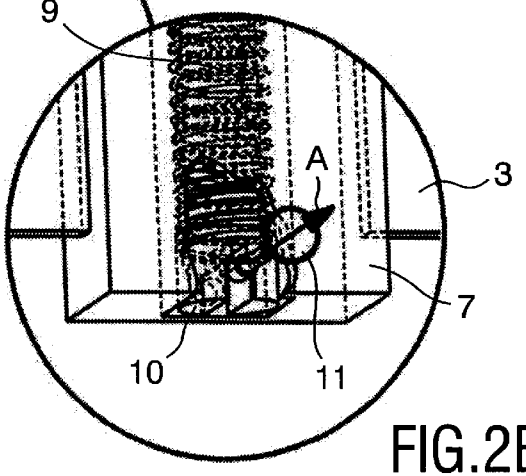
FIGS. 2A and 2B show part of the frame in more detail.
Figure 2A:
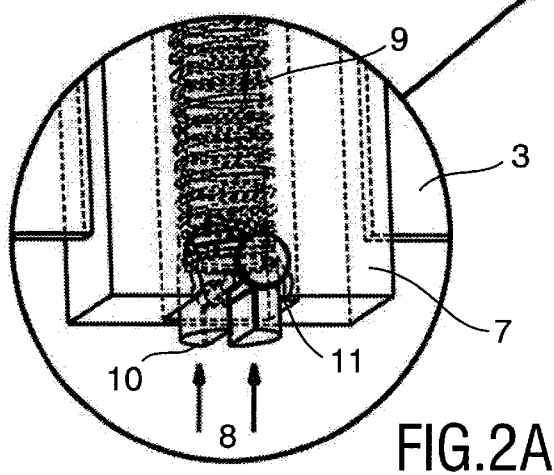

FIG. 1 shows a frame 2 of a packaging system 1 according to the invention. FIGS. 2A and 2B show part of the frame 2 in more detail. The frame 2 is constructed from a number of longitudinal beams 3 running essentially parallel to each other at some mutual distance. The longitudinal beams 3 are at one end thereof provided with a convexly curved portion 3A. The radius of the corresponding curve starts in the center of gravity of the packed frame. The function hereof will be explained herein below. Longitudinal beams 3 are mutually connected by means of cross beams 4, which likewise run essentially parallel to each other at some mutual distance.

The size of the frame 2 and the number and size of the beams 3 and 4 can be optimally adjusted to the medical device it is intended to support. Various suitable materials can be used for the frame. Preferably the frame is made of wood. Wood is easily to model and is cheap, which makes it very suitable for one time use. For ease of explanation the frame is situated horizontally on a floor 5 forming part of a box 6 (shown in FIG. 5) suitable for transportation by air.

The frame 2 is provided on two sides with a housing 7 for accommodating assisting means 8 that are shown in more detail in FIGS. 2A and 2B. FIG. 2A shows the position of the assisting means 8 when the frame is unloaded, whereas FIG. 2B shows the position of the assisting means 8 when the frame is loaded. In the preferred embodiment shown the assisting means 8 comprise pushing elements, in this example comprising a spring 9, and biasing means, that in this example comprise a spring pressure piece 10 and a safety pin 11. The spring 9 is biased in the position shown by means of the spring pressure piece 10 and retained in that position by means of the safety pin 11. In the biased position the spring 9 is in its "ready state" and prepared to be activated on demand.

Figure 3:
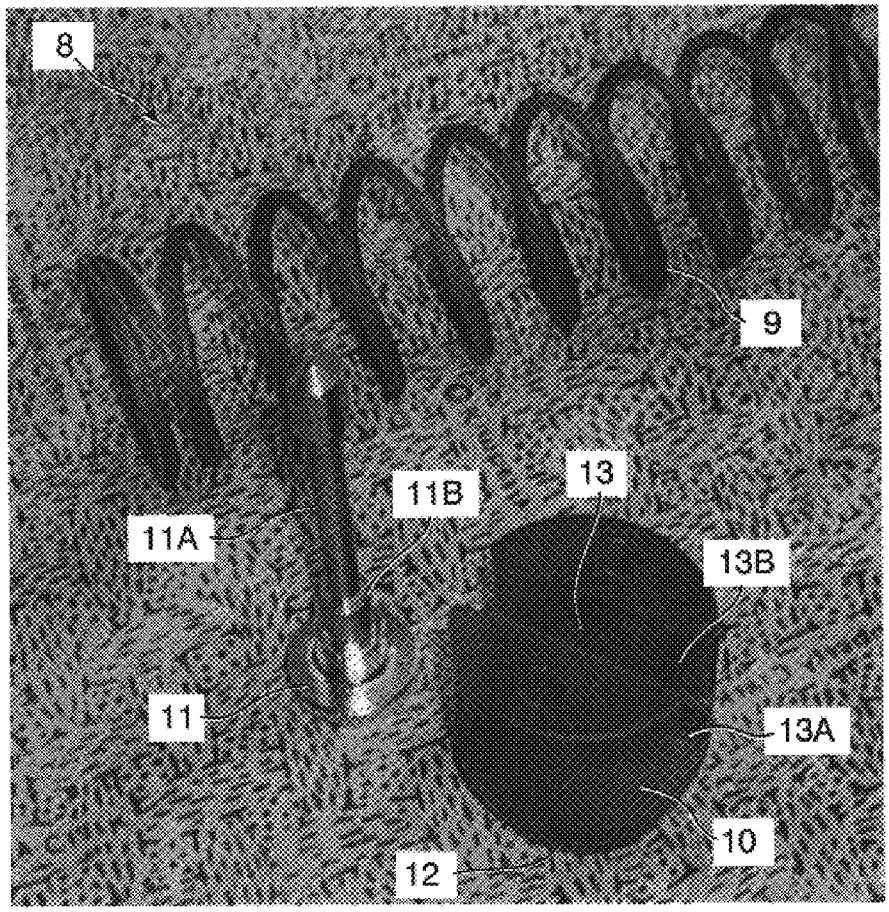
FIG. 3 shows the assisting means in more detail.

FIG. 3 shows the components of the assisting means 8 in more detail. The spring pressure piece 10 has a general cylinder shape and is provided with a protrusion 12 at one end face thereof that is to be inserted in the spring 9. At the other end face the spring pressure piece 10 is provided with a recess 13 for pin 11. Recess 13 has a deepened portion 13A having a smaller width than the remaining part 13B of the recess. Pin 11 has smaller part 11A having a width corresponding to the width of the deepened portion 13A of the recess. Pin 11 also has a thicker part 11 B having a width corresponding to the width of the part 13B of the recess.

When the frame 2 is not loaded the spring 9, when biased, will push the spring pressure piece 10 outward blocked by the pin 11 having its smaller part 11A in the deepened portion 13A of the recess. When the frame 2 is in horizontal position and loaded with a medical device the load will push the frame 2 downward against the action of the spring 9 thus pushing the spring pressure piece 10 slightly inward. The wider part 13B of the recess is now moved over the pin 11 thus unblocking the pin that is now ready to be pulled out. The characteristics of the assisting means, in this example the spring 9, are preferably adapted to the medical device in question that needs to be transported. The spring force is preferably chosen such that gravity keeps the loaded frame 2 on the floor 5, so the blocking means 11 can be safely removed, either before or after transportation.

It is noted that as an alternative to the spring construction shown other means known perse may be used to perform the function of the assisting means. In general a support element is needed that can be activated to push the frame upwards against the force of gravity. As an example fluid pressure devices may be used, such as gas cylinders or even hydraulic cylinders. The preparation of such cylinders includes pushing them inwards to their "ready state" from which they can be activated on demand. The blocking of the assisting means can be performed mechanically as shown, as well as electronically or by means of any other suitable technique.

FIGS. 4A through 4D illustrate the operation of the packaging system according to the invention.

Figures 4A, 4B, 4C, 4D:
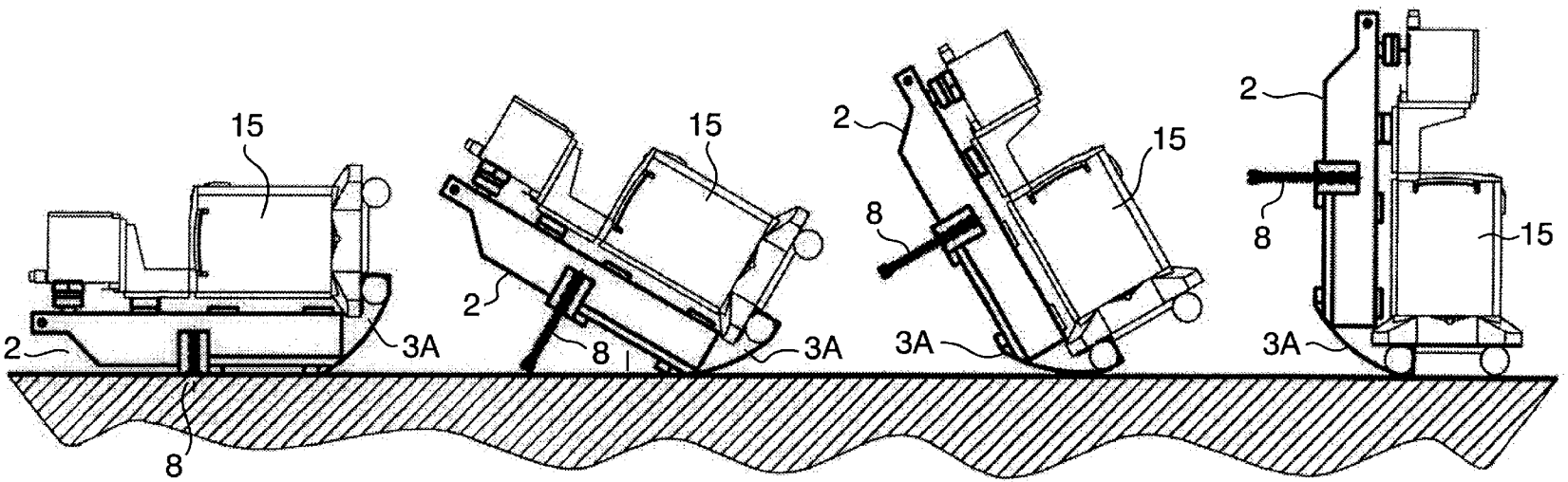
FIGS. 4A through 4D illustrate the working of the packaging system according to the invention.

In FIG. 4A the frame 2 is shown in a horizontal position loaded with a medical device, in this case a mobile viewing station 15 as part of a mobile C arm system. For unpacking the device first the assisting means 8 need to be unblocked or freed by removing the pin 11 from the recess 13. Preferably the pin will be removed after the device is packed in the packaging system before transportation. The assisting means can now be activated. In the example shown the springs are activated when, during unpacking, the field engineer starts lifting the device 15. It is then that the spring 9 starts to assist by pushing the mobile viewing station 15 towards the upright position thereof as shown in FIG. 4B. FIG. 4C illustrates the function of the curved portion 3A that assists the assisting means 8 in rolling mobile viewing station 15 to its upright position shown in FIG. 4D. At the moment the pushing elements or springs 9 have done their job, the curve takes over, and makes lifting up the packed system only a matter of rolling the frame over the curved end of the frame. The type of measure(s) necessary to activate other types of assisting means depend on the assisting means in question. The activating of such assisting means can be performed by hand, as well as mechanically, electronically or by means of any other suitable technique apparent to any person skilled in the art. As an example the cylinders mentioned can be activated pneumatically or electronically.

Figure 5:
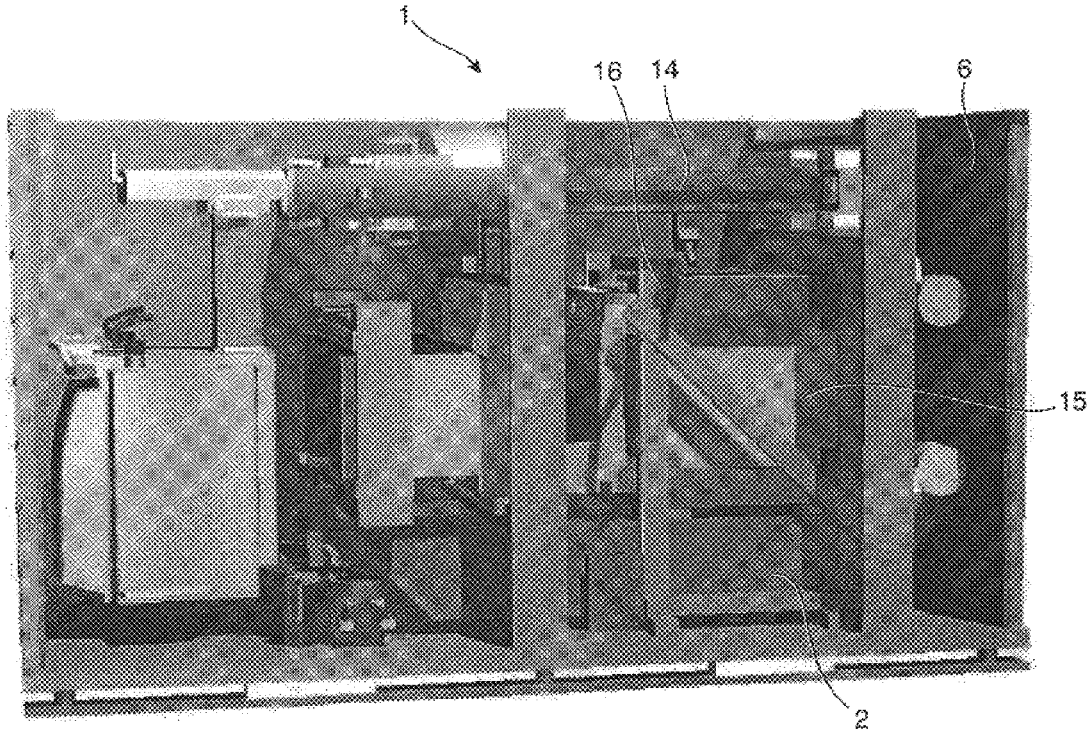
FIG. 5 shows packaging system according to the invention packed with a mobile C-arm system.

Generally the blocking of the assisting means is optionally and may take place after the preparation of the assisting means. The unblocking of the assisting means then needs to be performed before the activation of the assisting means. As will be apparent the unblocking of the assisting means implicates reversing the blocking and can thus be performed mechanically as shown, as well as electronically or by means of any other suitable technique. FIG. 5 shows the packaging system 1 according to the invention packed with medical devices. The medical devices are components of an X-ray device, in this example a mobile C-arm system. Such a mobile C-arm system is known in the field. It comprises a mobile C-arm stand 14 for imaging a subject and a mobile view station 15 for viewing the resulting images.

Using the packaging system 1 the mobile view station 15 is packed in a horizontal position supported by the frame 2 to which it is fastened by suitable fastening means 16. In the example shown the fastening means comprise a number of beams forming a casing that is preferably made of wood. The frame 2 is to be inserted in a box 6 for air transportation. However, in box 6 there is sufficient space left for the mobile C-arm stand 14 that can be placed on top of the packed mobile view station 15. The volume of the total packaging system is thus greatly reduced allowing the volume of the box 6 to be optimally used.

Summarizing the invention provides a compact packing system for a medical device that assists in unpacking itself. Using the packaging system according to the invention medical devices can be transported in less time at lower cost without the need for extra personnel and/or aiding means for unpacking the device.

The invention is of course not limited to the described or shown embodiment, but generally extends to any embodiment, which falls within the scope of the appended claims as seen in light of the foregoing description and drawings.

What is claimed is:

1. A packaging system for one or more devices intended for medical use, the packaging system being arranged for transporting at least one of the devices in an essentially laid-down position, the packaging system comprising:

a frame for supporting the at least one device in the laid-down position; and means coupled to the frame for assisting in positioning the device towards an essentially upright position during unpacking thereof, wherein the assisting means comprise one or more pushing elements for at least partly pushing the frame towards an essentially upright position, wherein the pushing elements comprise a spring construction, wherein the assisting means further comprise biasing means for biasing the pushing elements against the force of gravity acting on the frame, wherein the biasing means comprise a spring pressure piece for each spring and an accompanying blocking element that is arranged for blocking the spring pressure piece when the frame is essentially empty and for releasing the spring pressure piece when the frame is loaded with the at least one device.

2. The system according to claim 1, wherein the blocking element comprises a pin having a smaller part and a wider part, wherein the spring piece is provided with a recess having a width for cooperation with the wider part of the pin and having a smaller deepened portion for cooperation with the smaller part of the pin.

3. The system according to claim 1, wherein the frame comprises means for at least partly rolling the frame.

4. The system according to claim 3, wherein the frame is curved at at least one end thereof.

5. A frame as described as part of the packaging system according to claim 1.

6. A method of packing one or more devices intended for medical use using the packaging system according to claim 1, said method comprising:

packing at least one of the devices in an essentially laid-down position on the frame; and preparing the assisting means to assist in unpacking on demand.

7. The method of packing according to claim 6, further comprising:

putting another device intended for medical use on top of the at least one device packed in the essentially laid-down position on the frame; and placing the frame packed with the at least two devices in a box for transportation.

8. The method of unpacking a packaging system packed with one or more devices intended for medical use according to the method of claim 6, said method further comprising:

activating the assisting means; and unpacking the at least one device packed in the essentially laid-down position with the help of the assisting means towards its essentially upright position.

9. A method of transporting one or more devices intended for medical use, said method comprising:

packing the one or more devices according to the method of claim 6;

transporting the packaging system; and unpacking at least one of the packed devices by activating the assisting means and unpacking the at least one device packed in the essentially laid-down position with the help of the assisting means towards its essentially upright position.

* * * * *